United States Patent [19]

Shoup et al.

[11] 4,199,904

[45] Apr. 29, 1980

[54] RETRACTABLE BLAST WHEEL CARRIER

[75] Inventors: Gary L. Shoup, Greencastle, Pa.; Jack B. Grier, Hagerstown, Md.

[73] Assignee: The Carborundum Company, Niagara Falls, N.Y.

[21] Appl. No.: 856,934

[22] Filed: Dec. 2, 1977

[51] Int. Cl.[2] ..... B24C 3/30

[52] U.S. Cl. ..... 51/423; 51/432; 51/433

[58] Field of Search ..... 51/423, 422, 426, 431, 51/432, 433

[56] References Cited

U.S. PATENT DOCUMENTS

| | | | |
|---|---|---|---|
| 1,343,350 | 6/1920 | Coburn | 51/422 |
| 2,434,881 | 1/1948 | Dill | 51/431 |
| 3,693,296 | 8/1972 | Carpenter | 51/423 |
| 3,821,866 | 7/1974 | Carpenter | 51/422 |

FOREIGN PATENT DOCUMENTS

| | | | |
|---|---|---|---|
| 310472 | 1/1919 | Fed. Rep. of Germany | 51/422 |

*Primary Examiner*—Harold D. Whitehead
*Assistant Examiner*—K. Bradford Adolphson
*Attorney, Agent, or Firm*—David E. Dougherty; William H. Holt

[57] ABSTRACT

Apparatus for mounting a plurality of centrifugal throwing wheels within a blast drum contained within a blast cabinet such that the throwing wheels are carried by a set of tracks which permit the throwing wheels to be rolled into and out of the blast cabinet. A feed screw is located within the blast drum for transporting abrasive particles to the throwing wheels and cooling ducts are located within the blast drum for carrying a flow of air to the throwing wheels. The feed screw and cooling ducts are fixedly located within the blast drum and do not move when the throwing wheels are retracted therefrom.

7 Claims, 6 Drawing Figures

RETRACTABLE BLAST WHEEL CARRIER

BACKGROUND OF THE INVENTION

U.S. Pat. No. 3,693,296 discloses a workpiece treating apparatus of the type which includes a plurality of centrifugal throwing wheels which are moveable into and retractable from a blast drum and blast cabinet. A cantilevered boom is provided for supporting the throwing wheels such that the throwing wheels are built integral with the boom and the boom is mounted on a boom car for support and mobility. Also built integral with the boom and supported by the boom car is the abrasive feed conveyor, including a drive means therefore, as well as a ventilating fan and duct work.

While the apparatus disclosed by U.S. Pat. No. 3,693,296 operates in a satisfactory manner, various features in its design can be improved. The cantilevered boom requires heavy structural design of the boom and boom car to resist deflection. Also, if additional or larger throwing wheels are used, thus extending the length of the boom, the supporting structure becomes excessively large. Further, the boom car supporting the cantilevered boom results in an increase of the space requirement for the total apparatus. Still further, support equipment (e.g., motor cooling blower, vent piping, abrasive gate solenoid valves and piping) must be mounted on the moveable boom car and thus requires flexible connections to plant utilities.

SUMMARY OF THE INVENTION

The present invention relates to the field of blast cleaning wherein workpieces are cleaned, or otherwise worked upon, by abrasive particles and the like which are thrown at high velocity against the workpieces by centrifugal throwing wheels. More particularly, the present invention relates to a retractable blast wheel carrier and support mechanism for moving throwing wheels into and out of a blast cabinet so as to provide for easy maintenance and the like.

A blast wheel carrier apparatus for use with the blast cabinet comprises track means having a first portion mountable within the blast cabinet and a second portion mountable outside of the blast cabinet, hanger means depending from the track means and including means for moving the hanger means between the first portion and the second portion of the track means, throwing wheel means carried by the hanger means, and means securing the throwing wheel means to the hanger means for movement therewith between the first portion and the second portion of the track means.

The apparatus is further characterized by the inclusion of feed means disposed adjacent to the first portion of the track means for feeding abrasive particles and the like to the throwing wheel means, and cooling means disposed adjacent to the first portion of the track means for providing a flow of air to the throwing wheel means.

The apparatus is further characterized in that the track means includes a pair of channel members disposed in spaced parallel relation and extending generally horizontal, and the hanger means includes spaced wheel means carried by and rotatable along the channel members.

A primary object of the present invention is to provide improved apparatus for supporting a plurality of throwing wheels for movement into and out of a blast cabinet wherein the supporting structure requirements are minimized and the space requirements of the apparatus are less than that required by the prior art.

Another object of the invention is to provide a blast treating apparatus wherein the abrasive feed screw conveyor and throwing wheel cooling ducts are fixedly secured within the blast cabinet and are not moveable with the throwing wheels as the throwings wheels are moved into and out of the blast cabinet.

Various other objects and advantages of the invention will hereinafter become more fully apparent from the following description illustrating a presently preferred embodiment thereof.

DESCRIPTION OF THE PREFERRED EMBODIMENT

Figure 1:
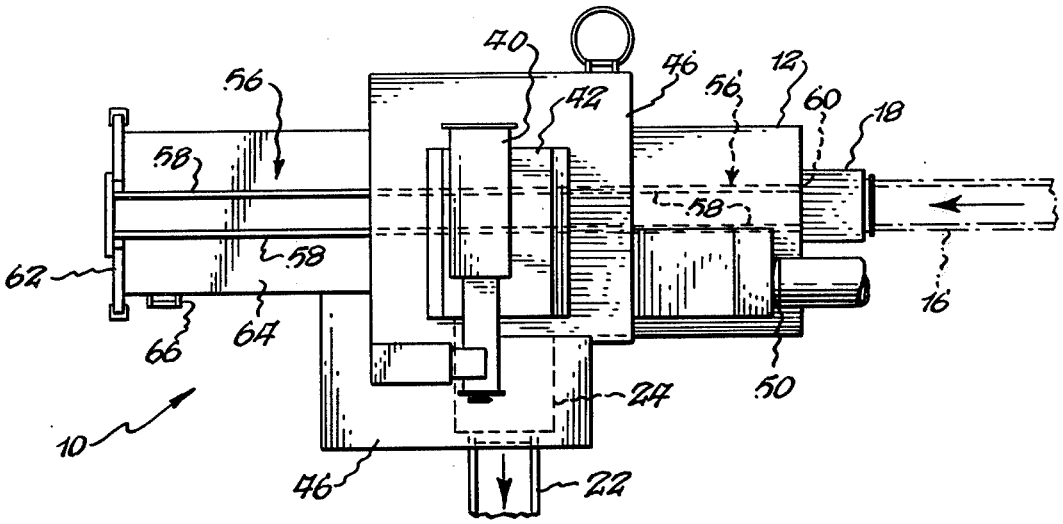
FIG. 1 is an overall plan view of blast treating apparatus constructed in accordance with the present invention.
Figure 2:
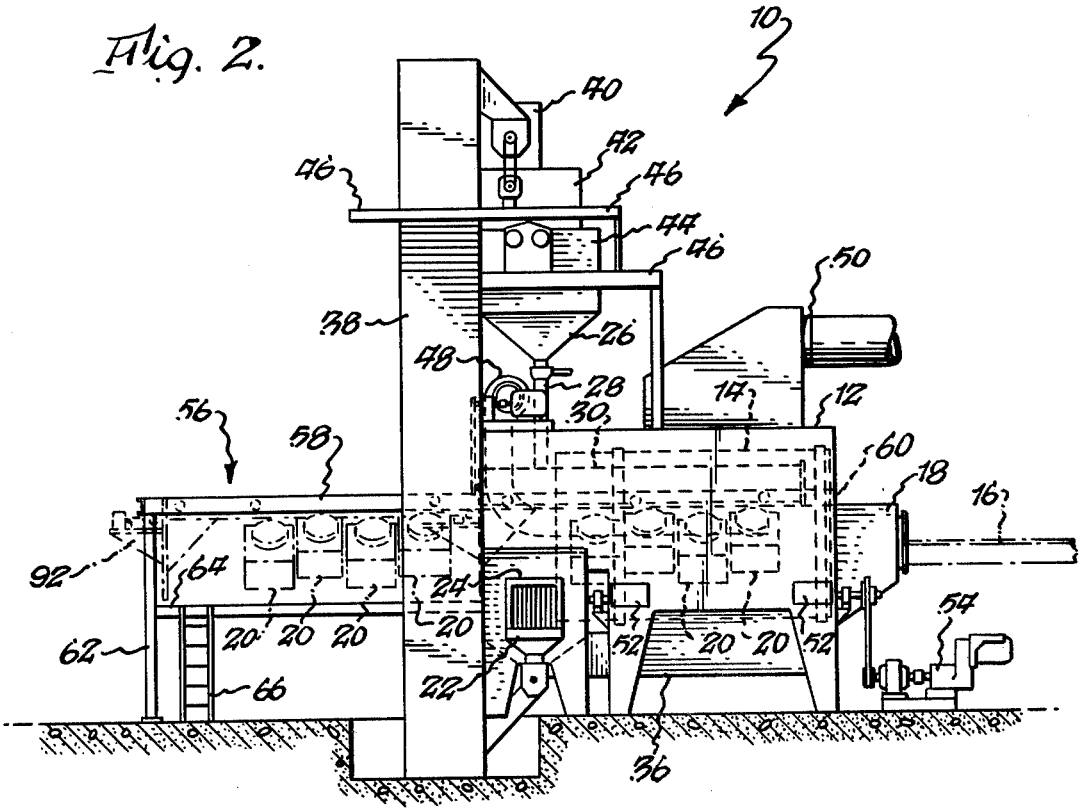
FIG. 2 is a side elevational view of the blast treating apparatus.
Figure 3:
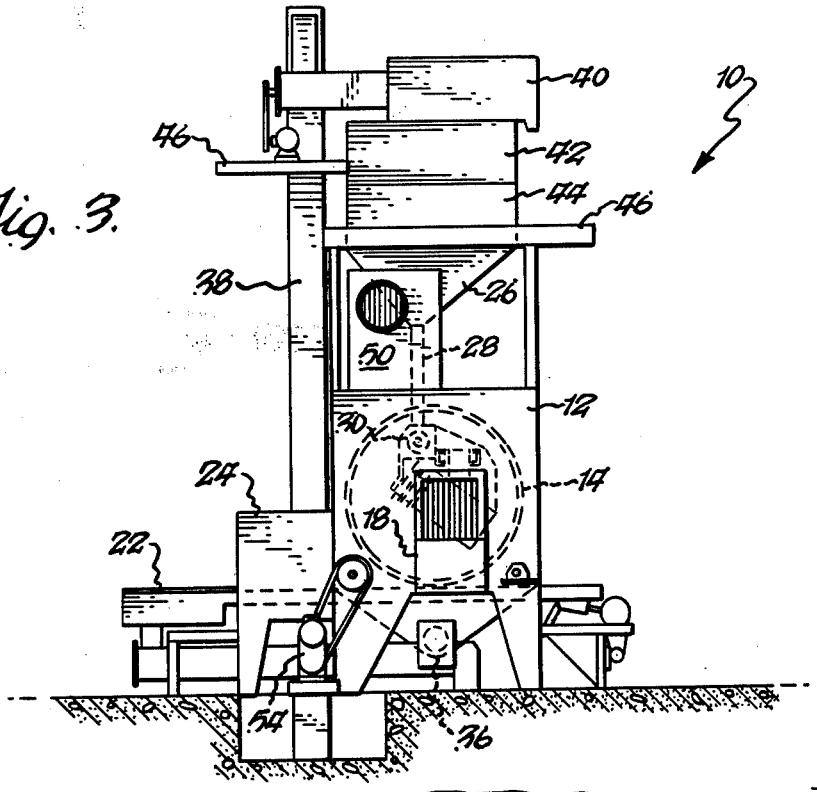
FIG. 3 is an end elevational view of the blast treating apparatus.

Referring to FIGS. 1–3, a workpiece treating apparatus, generally indicated by the numeral 10, includes a large, box-like blast cabinet 12 which has contained therein a rotatable blast drum 14. An inlet feed conveyor 16 is provided for introducing workpieces, such as metal castings and the like, into an inlet vestibule 18 so that the workpieces are disposed within the blast drum 14 to be acted upon a plurality of centrifugal throwing wheel 20. During operation of the apparatus 10, the workpieces are caused to move through the blast drum 14, usually by a spiral or helical vane (not shown) fixedly secured to the inside periphery of the blast drum 14. After completion of the blast treatment, the workpieces are caused to exit from the blast cabinet 12 on an outlet feed conveyor 22 through an exit vestibule 24.

The workpiece apparatus 10 includes the usual conventional components which are well known to those skilled in the art. Briefly, these components include an abrasive particle storage bin 26 having a feed pipe 28 at its lower-most end for feeding the abrasive particles and the like to a feed screw conveyor 30 which is rotatably driven within an enclosed chamber 32 (FIGS. 4 and 5) for feeding abrasive particles through adjustable orifice plates 34 to respective ones of the throwing wheels 20. During operation of the workpiece treating apparatus 10, the used abrasive particles are collected by a screw conveyor 36 and transported upwardly through an elevator 38 and passed into a scalping drum 40 and then into a primary storage bin 42. Thereafter, the abrasive particles are passed through an airwash separator 44 wherein the abrasive particles are cleaned of undesirable debris and then introduced back into the storage bin 26. Typically, the apparatus 10 also includes a series of service platforms 46 with access ladders and safety railings (not shown). In addition, there is provided an exhaust fan 48 for cooling the throwing wheels 20, and a vent hood 50 for withdrawing dust and air from the blast cabinet 12. Conventionally, the blast drum 14 is mounted upon spaced pairs of rollers 52 and is rotatably driven by a variable speed work conveyor drive 54.

According to the present invention, a set of tracks, generally indicated by the numeral 56, is comprised of a pair of horizontally disposed, elongated channel members 58 which have a first portion thereof extending through the blast drum 14 and having one end attached, at 60, to the entrance end wall of the blast cabinet 12. A second portion of the tracks 56 extends outwardly from the blast cabinet 12 such that the other ends of the channel members 58 are supported upon a support frame 62 such that the plurality of throwing wheels 20 (typically four wheels, as shown) may be retracted from within the blast cabinet 12 and blast drum 14 for maintenance purposes and the like. In this regard, a service platform 64, an access ladder 66 and a safety railing (not shown) are provided.

Figure 4:
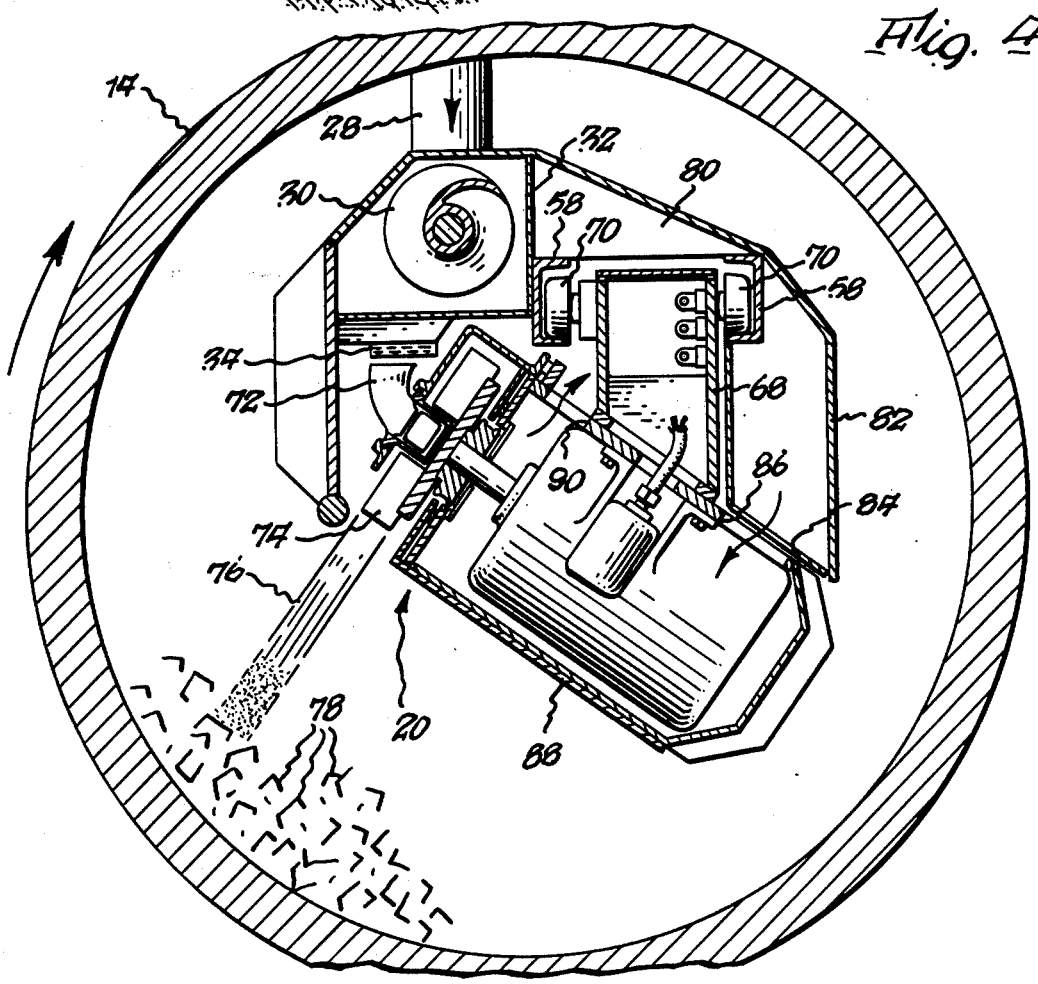
FIG. 4 is an enlarged fragmentary view, partly in section, and illustrates blast wheel carrier apparatus and support mechanism therefore all contained within a rotatable blast drum.
Figure 5:
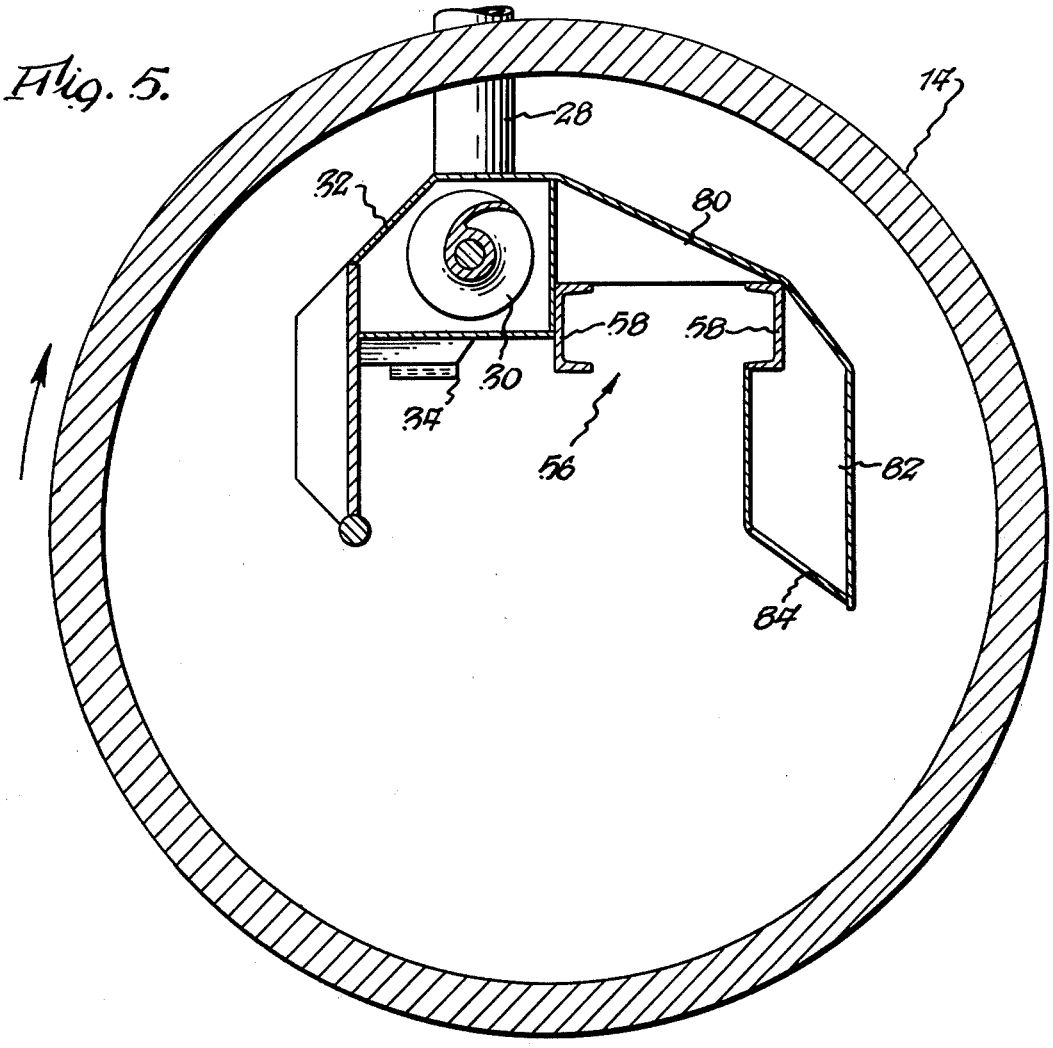
FIG. 5 is an enlarged fragmentary view, partly in section, similar to FIG. 4, except that the throwing wheel mechanism has been removed from within the blast drum.
Figure 6:
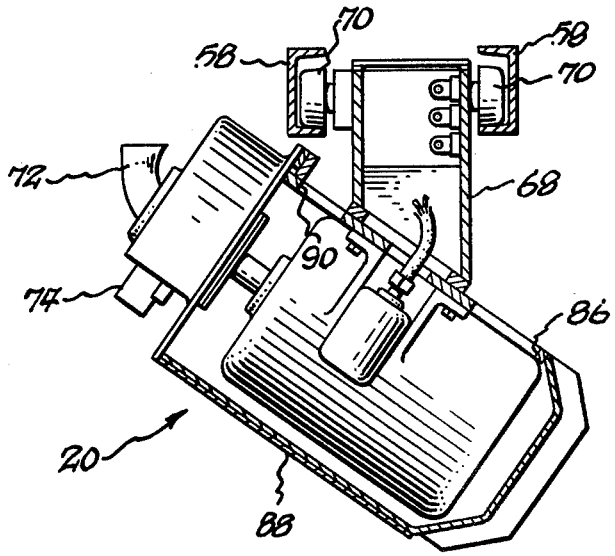
FIG. 6 is a view of the throwing wheel mechanism as it is supported upon a portion of the mounting tracks outside of the blast drum.

As is best shown in FIGS. 4–6, the tracks 56, comprised of channel members 58, are disposed to support the throwing wheels 20 which are attached to a hanger construction 68 which is carried by spaced rollers or wheels 70, the wheels 70 being contained within, carried by and rotatable along the channel members 58 between the first portion thereof within the blast drum 14 and the second portion thereof outside of the blast cabinet 12 and located above the platform 64.

As is shown in FIGS. 4 and 5, the abrasive feed screw conveyor 30 and chamber 32 are attached to and supported by the channel members 58 so that abrasive particles are fed by gravity through the orifice plates 34 into an adjustably mounted feed spout 72 of the throwing wheel 20 such that the abrasive particles are thrown, in a conventional manner by throwing vanes 74 in the form of a blast stream 76 against the workpieces 78. A series of support gussets 80 are welded or otherwise affixed to the chamber 32 and the channel members 58 for supporting a hollow cooling duct 82 which contains an opening 84 for directing a flow of cooling air into an opening 86 formed in a protective casing 88 which surrounds the throwing wheel 20 and includes an exit port 90 for venting air therefrom into the blast drum 14. Thus, it will be appreciated that the feed screw 30 and cooling duct 82 both remain within the blast drum 14 while the throwing wheels 20 are moveable on wheels 70 into and out of the blast drum 14. This movement of the throwing wheels 20 is achieved, for example, by an air motor driven reducer 92 (FIG. 2) employing a sprocket and roller chain connected to the hanger 68.

While the invention has been described herein with reference to the preferred embodiment, it is to be understood that various changes and modifications may be made by those skilled in the art without departing from the spirit and scope of the invention as defined in the following claimed subject matter.

We claim:

1. A blast wheel carrier apparatus in combination with a blast cabinet and a blast drum, track means having a first end portion fixedly mounted in said blast cabinet and a second end portion fixedly mounted outside of said blast cabinet; hanger means depending from said track means and including means for moving said hanger means between said first end portion and said second end portion of said track means; throwing wheel means carried by said hanger means, means securing said throwing wheel means to said hanger means for movement therewith between said first end portion and said second end portion of said track means; and means mounting said blast drum for rotation inside of said blast cabinet and around said first end portion of said track means and said throwing wheel means.

2. Apparatus as defined in claim 1 including feed means fixedly mounted in said blast cabinet and disposed adjacent to said first end portion of said track means for feeding abrasive particles and the like to said throwing wheel means when said throwing wheel means are located near said first end portion of said track means.

3. Apparatus as defined in claim 1 including cooling means mounted in said blast cabinet and disposed adjacent to said first end portion of said track means for providing a flow of air to said throwing wheel means when said throwing wheel means are located near said first end portion of said track means.

4. Apparatus as defined in claim 1 wherein said track means includes a pair of channel members disposed in spaced parallel relation and extending generally horizontal, and said hanger means includes spaced wheel means carried by and rotatable along said channel members.

5. Apparatus as defined in claim 2 wherein said feed means includes a screw conveyor and adjustable orifice plates for controlling the flow of said abrasive particles from said screw conveyor to said throwing wheel means.

6. Apparatus as defined in claim 3 wherein said cooling means includes duct means, and openings in said duct means for directing said flow of air past said throwing wheel means.

7. Apparatus as defined in claim 4 wherein said channel members extend through said blast drum, said channel members being elongated and including a first end attached to said blast cabinet and an opposite end extending outwardly of said blast cabinet; and means for supporting said opposite end of said channel members for allowing retraction of said throwing wheel means from within said blast drum and blast cabinet.

* * * * *